US006208742B1

(12) United States Patent
Garcia et al.

(10) Patent No.: US 6,208,742 B1
(45) Date of Patent: Mar. 27, 2001

(54) ELECTRO-ACOUSTIC DYNAMIC TRANSDUCER SYSTEM FOR USE IN A LOUD SPEAKER

(75) Inventors: Arturo H. Garcia; Arturo J. Garcia, both of Miami, FL (US)

(73) Assignee: True Dimensional Sound, Inc., Coral Gables, FL (US)

( * ) Notice: Subject to any disclaimer, the term of this patent is extended or adjusted under 35 U.S.C. 154(b) by 0 days.

(21) Appl. No.: 09/376,212

(22) Filed: Aug. 18, 1999

Related U.S. Application Data

(60) Provisional application No. 60/097,044, filed on Aug. 19, 1998.

(51) Int. Cl.[7] ..... H04R 25/00

(52) U.S. Cl. ..... 381/401; 381/400; 381/406; 381/117

(58) Field of Search ..... 381/59, 117, 96, 381/400, 401, 396, 402, 406, FOR 152, FOR 154, FOR 155

(56) References Cited

U.S. PATENT DOCUMENTS

| | | | |
|---|---|---|---|
| 1,733,232 | * 10/1929 | Miessner | 381/117 |
| 1,743,749 | 1/1930 | Arkell . | |
| 1,763,846 | 6/1930 | Fay . | |
| 1,834,820 | 12/1931 | Bobb . | |
| 1,849,495 | 3/1932 | Lyle . | |
| 2,004,735 | 6/1935 | Thomas . | |
| 2,030,574 | 2/1936 | Dull . | |
| 2,042,966 | 6/1936 | Van B. Roberts . | |
| 2,084,944 | 6/1937 | Cornwell . | |
| 2,217,177 | 10/1940 | Massa . | |
| 2,261,111 | 11/1941 | Engholm . | |
| 2,727,949 | 12/1955 | Lokkesmoe . | |
| 2,770,681 | 11/1956 | Perry . | |
| 5,487,114 | 1/1996 | Dinh . | |

FOREIGN PATENT DOCUMENTS

| | | |
|---|---|---|
| WO 94/18806 | 8/1994 | (WO) . |

* cited by examiner

*Primary Examiner*—Huyen Le
(74) *Attorney, Agent, or Firm*—King & Schickli PLLC

(57) ABSTRACT

An electro-acoustic speaker having no permanent magnet. An audio input signal is applied to a pair of parallel coils, each being in series with a diode. The diodes are oppositely acting, so that the coils conduct during alternate half cycles of the input signal. As a result, the coils alternately generate magnetic flux for cooperative establishment of an unidirectional magnetic field. The input signal is also applied to a third coil for generation of a full wave current therethrough. This full wave current produces magnetic flux which establishes an alternating magnetic field. Interactions between the current-carrying coils and their respective magnetic fields produce acceleration forces for a speaker cone.

6 Claims, 3 Drawing Sheets

ELECTRO-ACOUSTIC DYNAMIC TRANSDUCER SYSTEM FOR USE IN A LOUD SPEAKER

CROSS-REFERENCE TO PROVISIONAL APPLICATION

This application claims the benefit of U.S. Provisional Application Ser. No. 60/097,044, filed Aug. 19, 1998, and entitled Electro-Acoustic Dynamic Transducer System for Use in a Loud Speaker, which is incorporated herein by reference.

BACKGROUND OF THE INVENTION

This invention relates to audio speakers and more particularly to a speaker transducer system which is lightweight and able to produce high quality sound.

High-quality prior art speakers have generally employed transducer systems comprising a permanent magnet and an electrical coil. An audio signal, corresponding to sounds to be generated, would be directed to the coil. The coil then would create a time-varying magnetic field which would interact with the field of the permanent magnet to drive the speaker. This has limited such speakers to relatively fixed installations due to the weight of the magnet.

Somewhat recently the magnet weight problem has been addressed by replacing the magnet with a second electrical coil, as disclosed in Dinh U.S. Pat. No. 5,487,114. The Dinh prior art is illustrated in FIG. 1 hereof, as indicated by the reference numeral 30.

Referring now to FIG. 1, a speaker 42 is oscillated in correspondence with an audio signal 36 through forces of attraction and repulsion acting on a movable coil 34. Signal 36 is applied across input lines 38, 40. A stationary coil 32 is connected to lines 38,40 by lead lines 46, 44. Coil 32 generates magnetic flux having a field strength which generally follows the amplitude of signal 36. When signal 36 changes sign the flux generated by stationary coil 32 reverses direction.

Moveable coil 34 is connected to input line 38 by a bridge arrangement 48, comprising 4 diodes 48*a*–48*d*. Bridge 48 connects moveable coil 34 in parallel with stationary coil 32 but rectifies the current flowing through the moveable coil. This rectified current causes moveable coil 34 to generate magnetic flux which follows the amplitude of signal 36, but without reversal. Thus moveable coil 34 is alternately attracted to and repelled by stationary coil 32.

The magnetic field at coil 34 due to coil 32 is proportional to $\sin(\omega t)$, where $\omega$ is the frequency of the audio signal 36, and the acceleration force acting on coil 34 is proportional to $\sin(\omega t)\mathrm{ABS}(\sin(\omega t))$. Ideally the acceleration force should be proportional simply to $\sin(\omega t)$, so the factor $\mathrm{ABS}(\sin(\omega t))$ introduces a small distortion error. The bridge diodes cannot switch at zero volts. A practical threshold is in a region of about 0.5 to 0.7 volts. Since bridge 48 places two diodes in series, the moveable coil cannot respond to signal reversals below about 1 volt. This is fairly substantial in a typical 5 volt system.

SUMMARY OF THE INVENTION

The present invention reduces distortion in a light weight, coil-driven speaker by minimizing threshold losses in diode switches.

In accordance with the practice of this invention the transducer system comprises three coils, two diodes and a speaker cone. Two of the coils are paired and operate alternately, each operating under switching control of a single diode. The third coil operates continuously and may be either stationary or moveable. The paired coils are fixed relative to each other. Relative motion occurs between the third coil and the paired coils. In a first embodiment of the invention the paired coils are stationary, while the third coil is moveable. In a second embodiment of the invention the third coil is stationary, and the paired coils are moveable.

Further in accordance with the practice of this invention all three coils are connected in parallel for reception of an audio signal. The moveable coil(s) is(are) mounted for driving a speaker cone. Preferably, the paired coils are wound in a bifilar arrangement on a common cylinder. The three coils may be incorporated into a magnetic circuit, if desired.

DETAILED DESCRIPTION OF THE PREFERRED EMBODIMENTS

Figure 2:
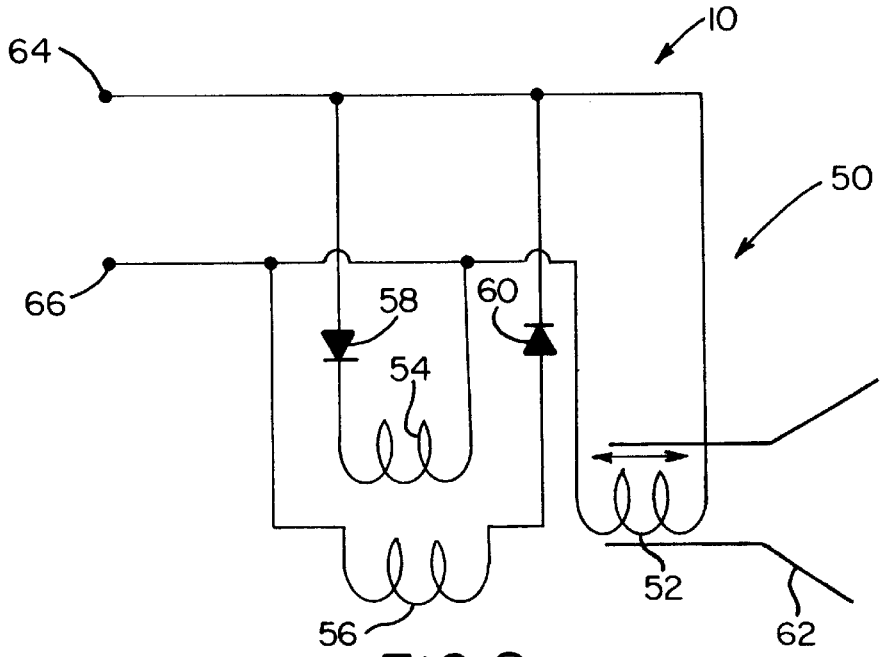
FIG. 2 is schematic diagram of a first embodiment of the present invention.
Figure 3:
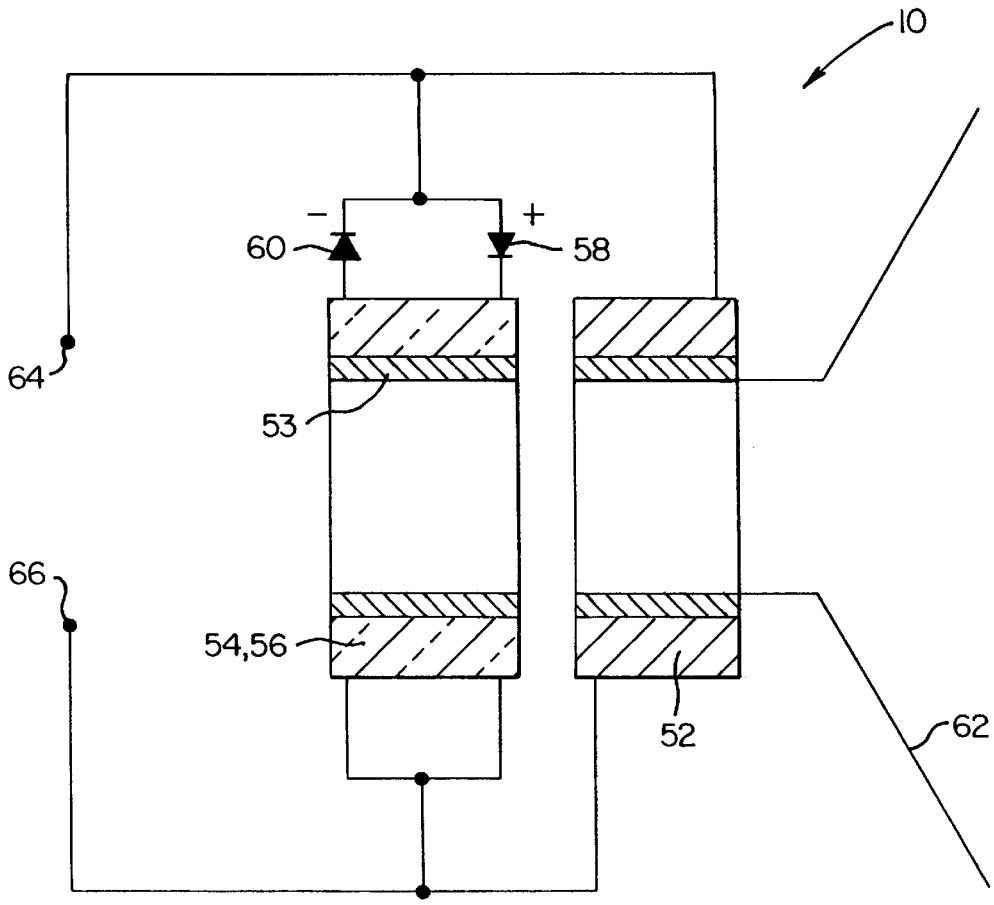
FIG. 3 is a sketch of a physical arrangement for the embodiment of FIG. 1.

A transducer system 10 constructed in accordance with a first embodiment of the present invention is illustrated in FIGS. 2 and 3. It comprises a first coil 54, a second coil 56 and a third coil 52. Coils 54, 56 are paired for complementary generation of a magnetic field and in this particular embodiment are stationary. Complementary generation of magnetic fields by coils 54 and 56 means that the two coils 54 and 56 generate substantially identical magnetic fields. Third coil 52 is axially moveable and is connected to a speaker cone 62 for production of sounds corresponding to an electrical signal applied to a pair of input terminals 64, 66. Suspension means (not shown) are provided for keeping the movable coil 52 and the cone 62 axially positioned for substantially unrestricted axial movement thereof without substantially restricting axial movement of those elements. Stationary coils 54, 56 are connected in parallel with movable coil 52. A first diode 58 is in series with first coil 54, and a second diode 60 is in series with second coil 56, so that the series combination of first diode 58 and first coil 54 is in parallel with the series combination of second diode 60 and second coil 56.

Figure 1:
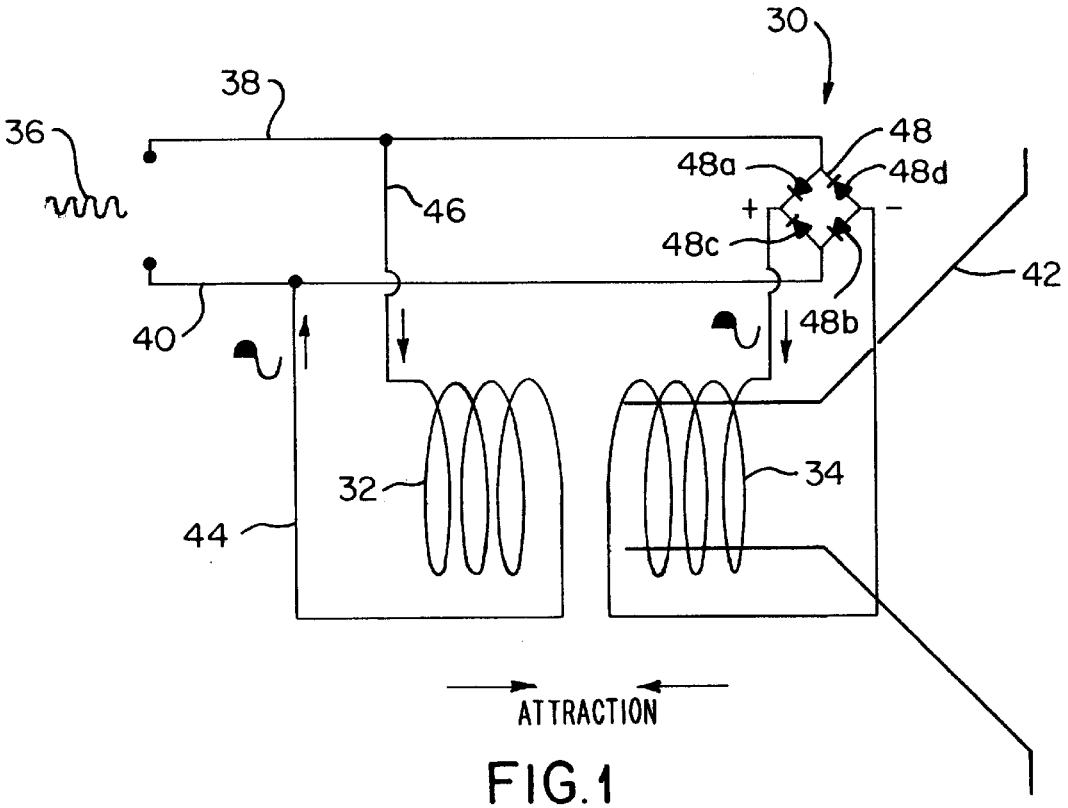
FIG.1 PRIOR ART
FIG. 1 is a sketch of a prior art electro-acoustic speaker.

The diodes 58, 60 are relatively reversed, so that first coil 54 conducts during positive half-cycles of an electrical signal at input terminals 64,66, while second coil 56 conducts during negative half-cycles of such a signal. The switching threshold is roughly half of the switching threshold for the prior art arrangement illustrated in FIG. 1, and sound quality is accordingly improved. First and second coils 54, 56 are preferably wound in bifilar fashion on a common cylindrical core 53, as best shown in FIG. 3. Terminal 66 is preferably connected to a source of ground potential and is not illustrated in FIG. 3.

When first coil 54 conducts, it generates a first magnetic flux which is directed axially toward third coil 52. That generates a magnetic field which in turn exerts an axial force against the current carrying winding of third coil 52. The direction of that force depends upon the direction of the current flow through third coil 52. When the current in terminal 64 changes direction, there is a corresponding directional change in the current through third coil 52. At the same time second coil 56 begins conducting and generates a second magnetic flux, while first coil 54 ceases conducting and terminates the first magnetic flux. The second magnetic flux has the same polarity as the first magnetic flux and acts in like manner against third coil 52. However, third coil 52 experiences a force reversal due to the above-mentioned current reversal therethrough. The net result is an acceleration of third coil 52 which follows variations in an audio signal applied across input terminals 64, 66. A connection of third coil 52 to the membrane of speaker cone 62 translates that acceleration into sound waves. It is preferred that the input voltage of the audio signal applied across the input terminals 64, 66 be greater than the threshold voltage of the diodes 58 and 60 and the inductance of each of the coils 54 and 56 be selected so as to minimize distortion.

Figure 4:
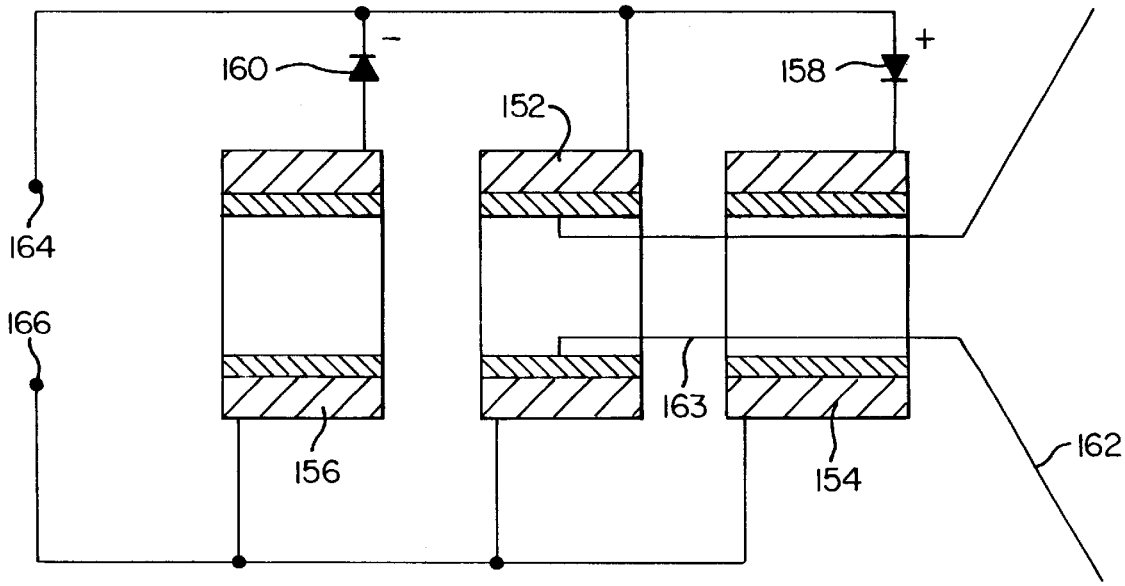
FIG. 4 is a sketch of a physical arrangement for a second embodiment of the invention.

A transducer system 150 constructed in accordance with a second embodiment of the present invention is illustrated in FIG. 4. This embodiment has a moveable coil 152 wound upon an extended length core 163. A speaker cone 162 is fixed to core 163 for producing audible sounds in response to axial vibration of moveable coil 152. A first stationary coil 154 is fitted concentrically about core 163 with an air gap therebetween. This allows axial movement of core 163.

There is a second stationary coil 156 axially aligned with first stationary coil 154, oppositely disposed with respect to moveable coil 152. A first diode 158 is connected in series with coil 154, and a second diode 160 is connected in series with coil 156. An input terminal 164 is connected to deliver an input signal to moveable coil 152, as well as to the series combinations of diode 158 with coil 154 and diode 160 with coil 156. Diodes 158, 160 are oppositely directed, so that coils 154, 156 conduct during alternate half cycles of an input signal at input terminal 164. From an electrical point of view, the operation of this embodiment is substantially identical to that of above-described first embodiment.

Figure 5:
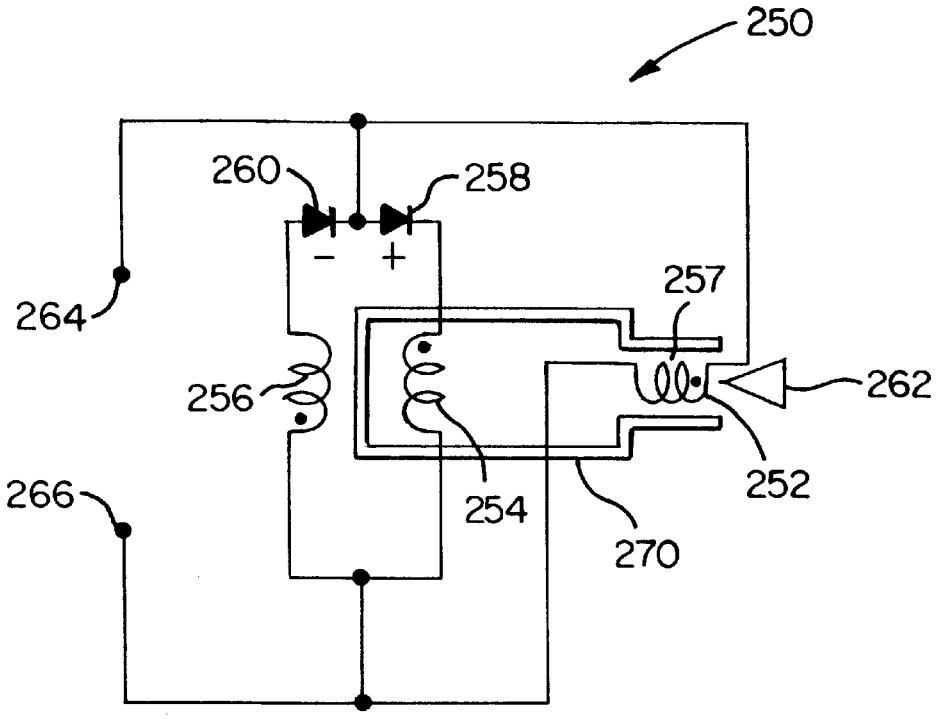
FIG. 5 is a schematic diagram of a third embodiment of the invention.

A third embodiment of the invention (250) may be configured as illustrated in FIG. 5. Principal elements of this embodiment are a speaker cone 262, a moveable coil 252, stationary coils 254, 256, diodes 258, 260, input terminals 264, 266 and magnetic circuit element 270. The latter element provides an efficient magnetic flux path between moveable coil 252 and stationary coils 254, 256 such that magnetic flux generated by coils 254 and 256 is provided to air gap 257. This magnetic field applies forces in alternating directions to coil 252. Magnetic circuit element 270 may be formed from steel or other magnetically permeable material. The operation is similar to that which has been described for the first and second embodiments.

Figure 6:
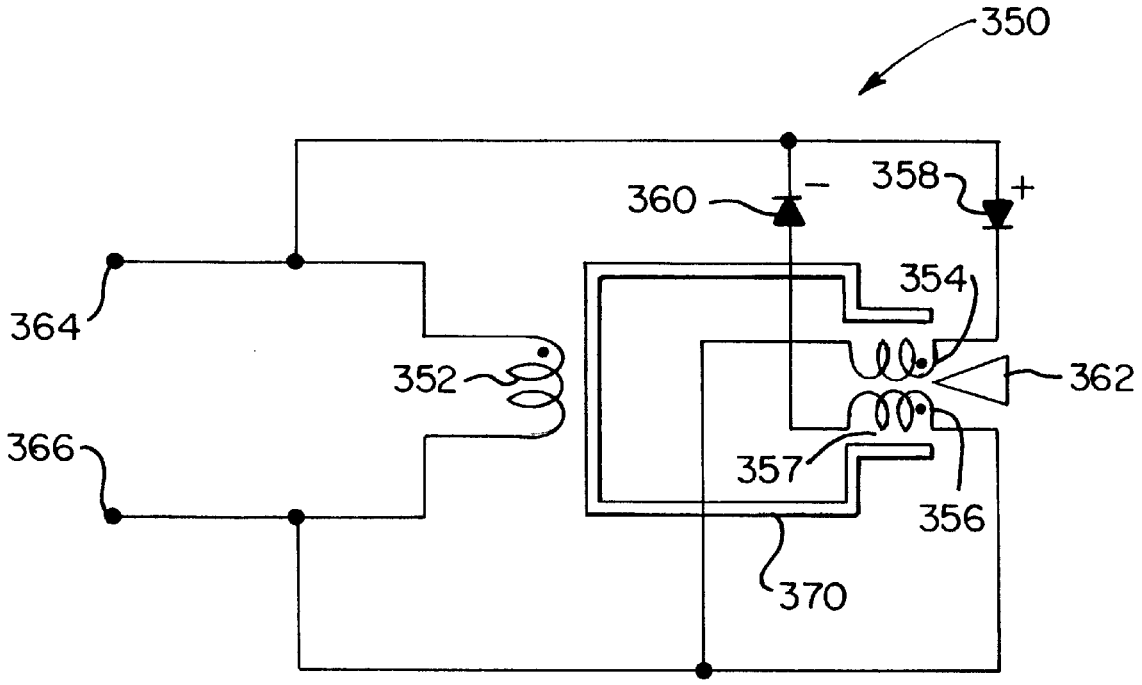
FIG. 6 is a schematic diagram of a fourth embodiment of the invention.

FIG. 6 illustrates a fourth embodiment of the invention (350) comprising speaker cone 362, coils 352, 354, 356, diodes 358, 360, input terminals 364, 366 and magnetic circuit element 370. This embodiment is similar to the fourth embodiment, with one major difference; the paired first and second coils 354, 356 are moveable, while the third coil 352 is stationary. An air gap 357 provides clearance for movement of coils 354, 356 between the magnetic circuit element. The magnetic flux generated by coil 352 is provided to air gap 357. The magnetic field applies forces in alternating directions to coils 354 and 356.

Other embodiments of the invention will be readily apparent from the above descriptions. While the forms of apparatus herein described constitute preferred embodiments of this invention, it is to be understood that the invention is not limited to these precise embodiments, and that changes may be made therein without departing from the scope of the invention which is defined in the appended claims.

What is claimed is:

1. An electro-acoustic speaker comprising:

(a) an input terminal;

(b) a first coil connected to said input terminal so as to generate a first magnetic flux in response to an electrical signal at said input terminal;

(c) a second coil connected to said input terminal so as to generate a second magnetic flux in response to said electrical signal;

(d) a first diode connected in series with said first coil;

(e) a second diode connected in series with said second coil and in such a way as to place the series combination of said second diode and said second coil in parallel with the series combination of said first diode and said first coil and to cause said first magnetic flux to be generated in response to positive values of said electrical signal and said second magnetic flux to be generated in response to negative values of said electrical signal, said first magnetic flux and said second magnetic flux being complementary;

(f) a third coil connected to said input terminal so as to generate a third magnetic flux in response to said electrical signal, said third magnetic flux extending in a first direction in response to positive values of said electrical signal and in a second direction reverse to said first direction in response to negative values of said electrical signal, said third magnetic flux being in a region of influence of said first and second magnetic fluxes, so that said electrical signal causes magnetic reaction forces in said first, second and third coils; and (g) a speaker cone mounted so as to be driven by said magnetic reaction forces.

2. An electro-acoustic speaker according to claim 1 wherein said third coil is moveable and is secured to said speaker cone.

3. An electro-acoustic speaker according to claim 2 wherein said first and second coils are bifilar and are co-axially wound about a common cylindrical core.

4. An electro-acoustic speaker according to claim 3 wherein said first, second and third coils are coaxial.

5. An electro-acoustic speaker according to claim 1 further comprising magnetic circuit means linking said first and second magnetic fluxes with said third magnetic flux.

6. An electro-acoustic speaker according to claim 1 wherein said third coil is stationary, and said first and second coils are moveable and are secured to said speaker cone.

* * * * *